US005123365A

United States Patent [19]

Ichimura

[11] Patent Number: 5,123,365

[45] Date of Patent: Jun. 23, 1992

[54] TAPED CHAINING THREAD SEWING DEVICE

[75] Inventor: Takashi Ichimura, Toyonaka, Japan

[73] Assignee: Pegasus Sewing Machine Mfg. Co., Ltd., Osaka, Japan

[21] Appl. No.: 616,199

[22] Filed: Nov. 20, 1990

[30] Foreign Application Priority Data

Nov. 29, 1989 [JP] Japan ..... 1-310052

[51] Int. Cl.[5] ..... D05B 1/20; D05B 37/04

[52] U.S. Cl. ..... 112/165; 112/122; 112/152; 112/288

[58] Field of Search ..... 112/162, 172, 288, 285, 112/287, 300, 152, 121.27, 130, 269.1, 177, 163, 165

[56] References Cited

U.S. PATENT DOCUMENTS 4,254,719 3/1981 Zawick ..... 112/152
4,777,892 10/1988 Aida et al. ..... 112/162

FOREIGN PATENT DOCUMENTS 0322783 7/1989 European Pat. Off. ..... 112/162
64-40090 2/1989 Japan ..... 112/288

*Primary Examiner*—Peter Nerbun
*Attorney, Agent, or Firm*—Jones, Tullar & Cooper

[57] ABSTRACT

A taped chaining thread sewing device is designed to sew by operation of an overedge sewing machine a tape into the upper surface of the fabric sent into the needle location of the sewing machine, and also sew the chaining thread cut off from the preceding fabric into the lower surface of the fabric. The tape is cut off together with the unnecessary edge portion of the fabric by a cutter at the start of sewing of the leading end from the sewing part on the fabric. Before the final end of the fabric passes the cutter, a tape guide of the taped chaining thread sewing device moves, and therefore the unsewn portion of the tape is cut off together with the unnecessary edge portion of the fabric from the sewn part by the cutter. By the chaining thread sewn into the beginning part of sewing of the fabric, it is not necessary to perform any particular bar tacking job at the beginning of sewing in a separate process. By properly setting the timing by which movement of a holding part of a chaining thread processing device is effected in the direction crossing the fabric, the length of the chaining thread to be sewn in may be set to a specific length.

14 Claims, 13 Drawing Sheets

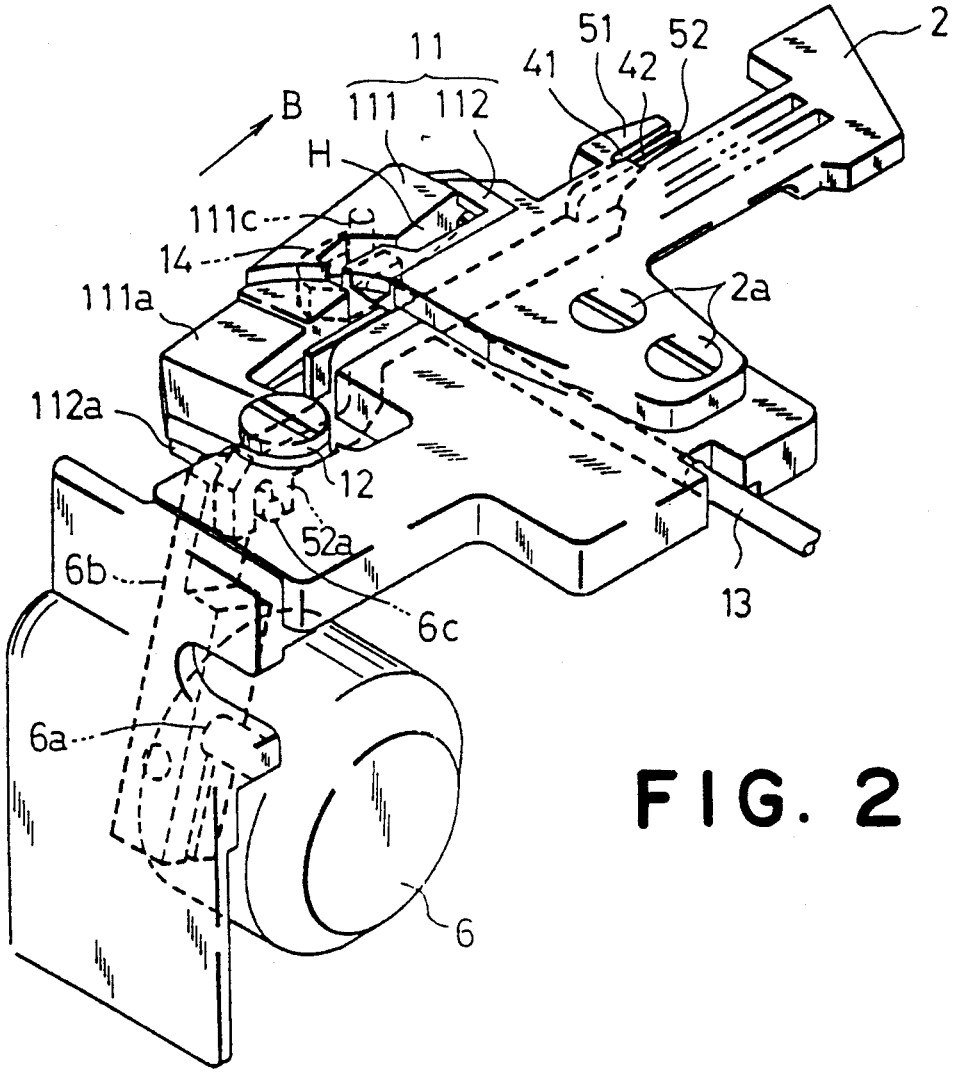
FIG. 2
FIG. 3A
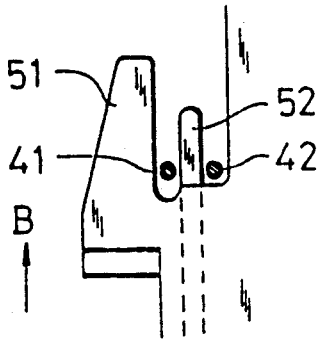
FIG. 3B
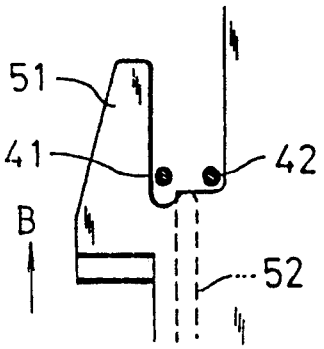

TAPED CHAINING THREAD SEWING DEVICE

BACKGROUND OF THE INVENTION

1. Field of the Invention

The present invention relates to a taped chaining thread sewing device to be installed in an overedge sewing machine preferably used for sewing, for example, the shoulder parts of the front body and the back body of underwear or the like.

2. Description of the Prior Art

In such underwear sewing, the front body and the back body are sewn together reversely. In this case, the shoulder sewing or shoulder joining is generally carried out by simultaneously sewing a tape into the front body side of the shoulder part to reinforce the shoulder part.

Hitherto, in such shoulder sewing, the right shoulder sides of the inverted front body and the back body are initially sewn together from the inner end toward the outer end part by means of the right overedge sewing machine having the leg part of the sewing machine main body disposed at the right side of the needle location, in the first place, and then, the neck line is sewn in tubing starting and ending at the inner end of the left shoulder side, by means of a double chain stitch sewing machine, and finally the left shoulder side is sewn from the outer end to the inner end part by the same right overedge sewing machine.

However, when the right and left shoulders are joined by using only the right overedge sewing machine, the outer ends of the right and left shoulders are bar-tacked by the subsequent step of attaching sleeves, and the inner end of the right shoulder is also bar-tacked by the tubing step after attaching the right shoulder. At the end of sewing the left shoulder, a chain stitch consecutive to the terminal end of the stitch is formed. Accordingly, in the prior art, in order to prevent loosening of the end of sewing of the left shoulder side, the neck is separately bar-tacked after inverting the fabric to the front side.

Such an additional step for neck bar-tacking complicates the manufacturing process, raises the manufacturing cost, and hence causes an increase in the product price.

SUMMARY OF THE INVENTION

In light of the above background, it is an object of the invention to provide a taped chaining thread sewing device capable of preventing unraveling of one end side not bar-tacked automatically in the subsequent process of sewing without any particular bar tacking operation, when sewing with taping so as to bar-tack the other end side automatically in the subsequent sewing process other than the particular bar tacking job, as in the case of attaching the left shoulder side as mentioned above, and also automatically cutting the tape at the beginning and end of sewing.

To achieve the above object, the taped chaining thread sewing machine of the invention comprises:

a tape guide for guiding the tape being left off from above into the needle location of the overedge sewing machine, a guide drive device capable of moving the tape send-out port of the tape guide between an action position opposite to the needle location and a waiting position set aside from the action position, in a direction which crosses the cloth feed direction, a chaining thread processing device capable of holding the free end of the chaining thread left over at the sewing machine side at the chaining thread holding part disposed before the needle location, and also moving in the direction so that the chaining thread holding part may cross with the cloth feed direction, and a cutting device located in the middle between a throat plate pawl forming the chaining thread and the chaining thread holding part of the chaining thread processing device, and also located in the position crossing with the chaining thread held by it when the chaining thread holding part is moved, with the movable cutter operating in cooperation with the driving of the overedge sewing machine, wherein the chaining thread processing device holds the chaining thread left over at the sewing machine side at the operator's side of the needle location, and the fabric is set in the sewing position, the tape being let off from the tape guide positioned at the action position by the guide drive device is inserted between the presser foot and the fabric. In this state the overedge sewing machine is driven. The tape let off from the from the tape guide is then sewn into the upper side of the fabric and the chaining thread held at the operator's side of the needle location is sewn into the lower side of the fabric, and the cutting device cuts off the leading tape from the portion sewn into the fabric together with the unnecessary edge portion of the fabric at the start of sewing. When the chaining thread is sewn into the fabric by a specified length, the chaining thread processing device moves the chaining thread holding part to cut the chaining thread by crossing with the cutting device, and the guide driving device moves the tape guide from the action position to the waiting position before the terminal end of the fabric passes the cutting part, the unsewn tape is crossed with the cutting device, and the crossed tape is cut off together with the fabric edge by the cutting device.

According to such a taped chaining thread sewing device, the tape is cut off at the beginning and end of sewing together with the fabric edge, is sewn in only the length necessary for the fabric, and will therefore not extend over the fabric. Hence, the quality of the product is enhanced, the job of cutting off excessive tape is not needed, and the manufacturing cost is reduced. Besides, as the chaining thread left over at the sewing machine side is sewn into the beginning part of sewn, unraveling in the sewing start part is prevented without having to perform any particular bar tacking job, and in the subsequent sewing process, by finishing sewing at the side to which the other fabric is to be sewn in the subsequent sewing process, the particular bar tacking process intended merely for preventing unraveling is omitted, thereby reducing the cost of manufacture.

In such taped chaining thread sewing device of the invention, by installing a sensor for detecting the presence or absence of the fabric before the needle location, the guide drive device can move the tape guide from the action position to the waiting position in accordance with the fabric terminal end detecting signal generated by this sensor.

In the taped chaining thread sewing device according to the invention, the guide drive device is designed to move the tape guide from the action position to the waiting position when the number of stitches per inch reaches a specific value from the start point of forming a seam on the fabric.

In such a taped chaining thread sewing device, if the overedge sewing machine is the left side sewing machine, when joining the shoulders of underwear or the like for sewing the front body and back body together, the left shoulder may be attached from the inner end side to the outer end side. That is, the sewing end part to which the chaining thread is consecutive is set at the outer side at which unraveling is prevented by attaching a sleeve, and by sewing the chaining thread simultaneously, the shoulder can be attached by setting the sewing start part capable of preventing unraveling at the inner end side. Therefore, the bar tacking job for the inner end side may be omitted.

Other features and effects of the invention will be better understood and appreciated from the following detailed description of the preferred embodiments taken in conjunction with the drawings.

BRIEF DESCRIPTION OF THE DRAWINGS

FIG. 2 is a perspective explanatory drawing of essential parts for showing the mechanism of moving the inside throat plate pawl back and forth.

FIG. 3A and FIG. 3B are plan views of essential parts for explaining the operation of the inside throat plate pawl.

DETAILED DESCRIPTION OF THE PREFERRED EMBODIMENTS

Figure 1:
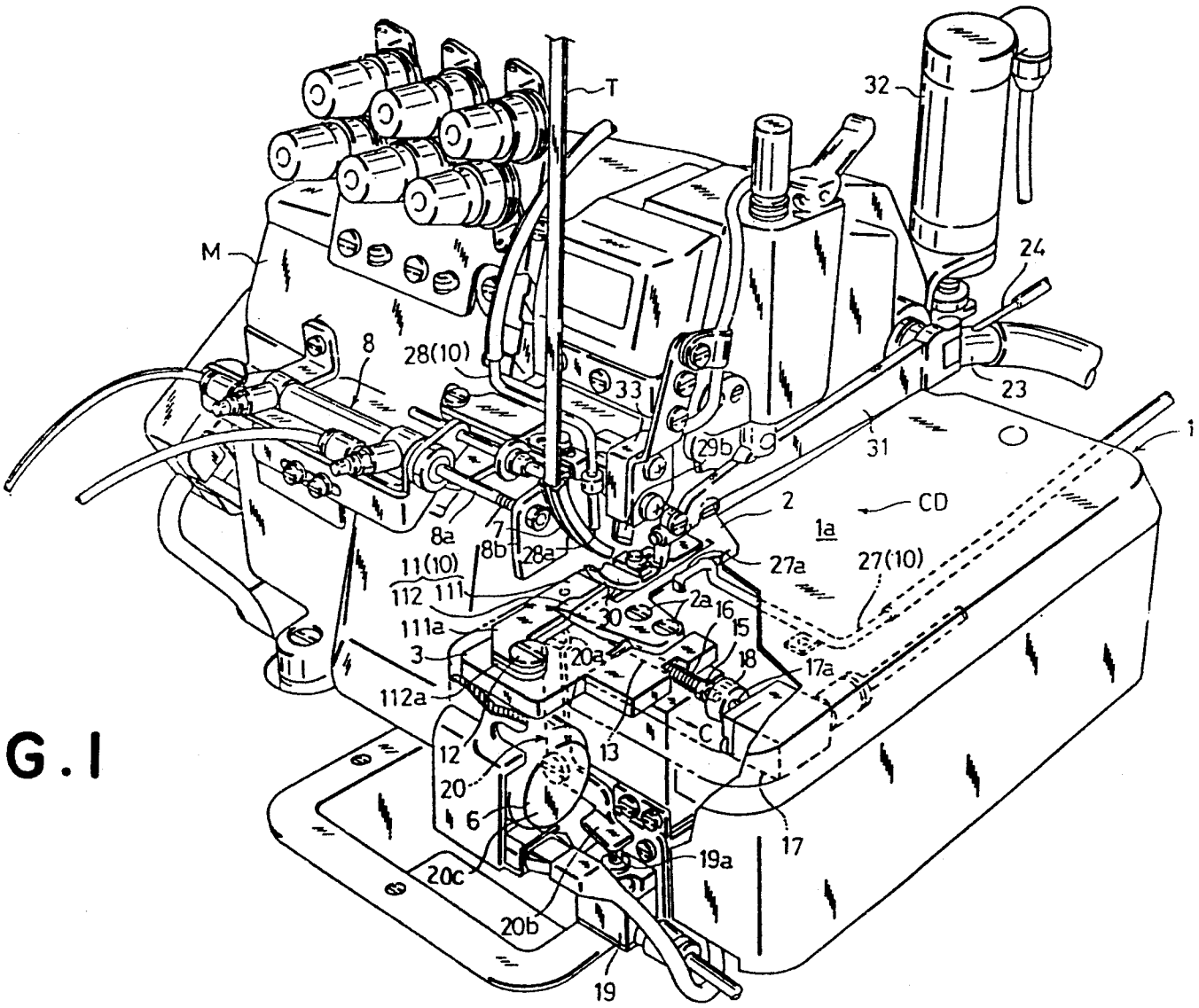
FIG. 1 is a partially cut-away perspective view of a left overedge sewing machine having a taped chaining thread sewing device.

A two-needle overedge sewing machine shown in FIG. 1 is equipped with a taped chaining thread sewing device CD. This overedge sewing machine is a left machine having a leg part of the sewing machine main body M located at the left side of the needle locations 41, 42 (See FIG. 2 to FIG. 3B) as seen from the operator's side of the sewing machine.

On a working plane 1*a* of a cloth plate 1 of this overedge sewing machine, a throat plate 2 is fitted at a position corresponding to the sewing machine needle. This throat plate 2 is affixed to a bracket 3 attached to the sewing machine main body M by means of bolts 2*a*. The upper surface of the throat plate 2 forms a part of the working plane 1*a*. As shown in FIGS. 2, 3A, 3B, the throat plate 2 has an outside needle location 41 and an inside needle location 42 penetrating the working plane 1*a* in the vertical direction. The needle locations 41, 42 are laid parallel in a direction orthogonal to the cloth feed direction.

On the throat plate 2, an outside throat plate pawl 51 is integrally formed, extending rearward (arrow B direction) from the part adjacent to the outside needle location 41. The inside throat plate pawl 52 of this two-needle overedge sewing machine can move back and forth between an action position and a waiting position. At the action position, as shown in FIG. 3A, the inside throat plate pawl 52 is parallel to the outside throat plate pawl 51 between the outside needle location 41 and the inside needle location 42. Besides, as shown in FIG. 3B, also at the waiting position, the inside throat plate pawl 52 is withdrawn behind the throat plate 2 before both needle locations 41, 42. The forward and backward movement of the inside throat plate pawl 52 is driven by a rotary solenoid 6 disposed behind the throat plate 2 at the operator's side. That is, the base side of the inside throat plate pawl 52 is extended to the operator's side beneath the throat plate 2, and a pin 6*c* provided in a drive lever 6*b* is engaged with its base end part 52*a*. The drive lever 6*b* is coupled with a drive shaft 6*a* of the rotary solenoid 6. Therefore, by controlling the driving of the rotary solenoid 6, the forward and backward movement of the inside throat plate pawl 52 may be controlled.

Figure 4:
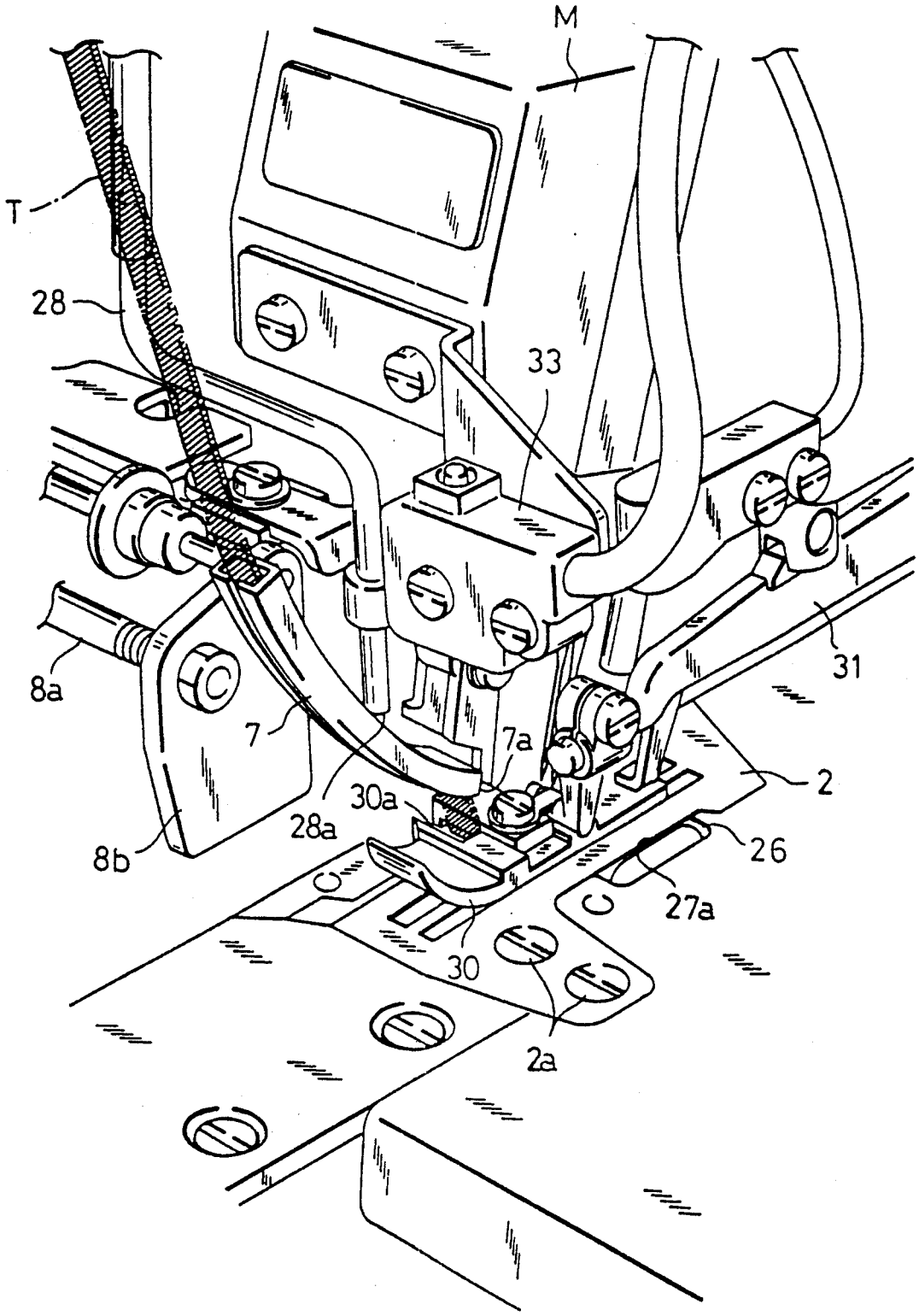
FIG. 4 is a perspective view of essential parts showing the guide state of the tape.

Above the throat plate 2, as shown in FIG. 4, there is a curved square tubular tape guide 7. This tape guide 7 is intended to allow the tape T sent out from above to pass through, and be let out from the front end tape outlet 7*a*.

This tape guide 7 is coupled with a piston rod 8*a* of an air cylinder 8 which is a guide drive device through a mounting member 8*b*. At the left side of the tape guide 7, the air cylinder 8 is fixed to the sewing machine main body M, and its piston rod 8*a* can move back and forth in the direction orthogonal to the cloth feeding direction of the sewing machine. Therefore, by controlling the expansion and suction of the air to this air cylinder 8, the tape guide 7 may be moved in the direction orthogonal to the cloth feeding direction. This movement is carried out between the action position where the tape outlet 7*a* is opposite to both needle locations 41, 42 and the waiting position at the left side of this action position.

Figure 5A:
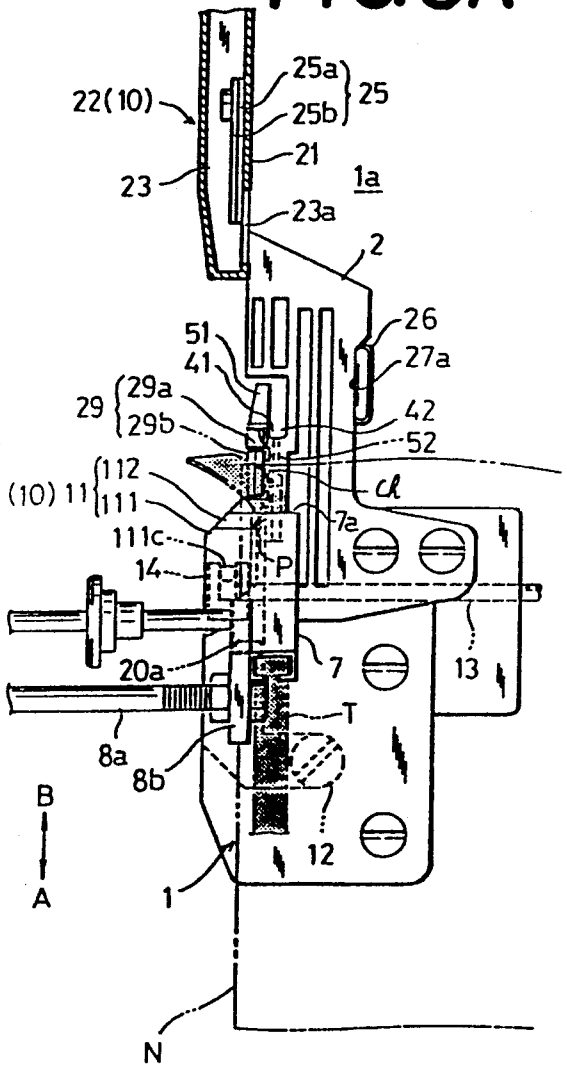
FIG. 5A to FIG. 5G are operation explanatory drawings showing the sewing process accompanying taping and chaining thread sewing by a left overedge sewing machine.
Figure 5B:
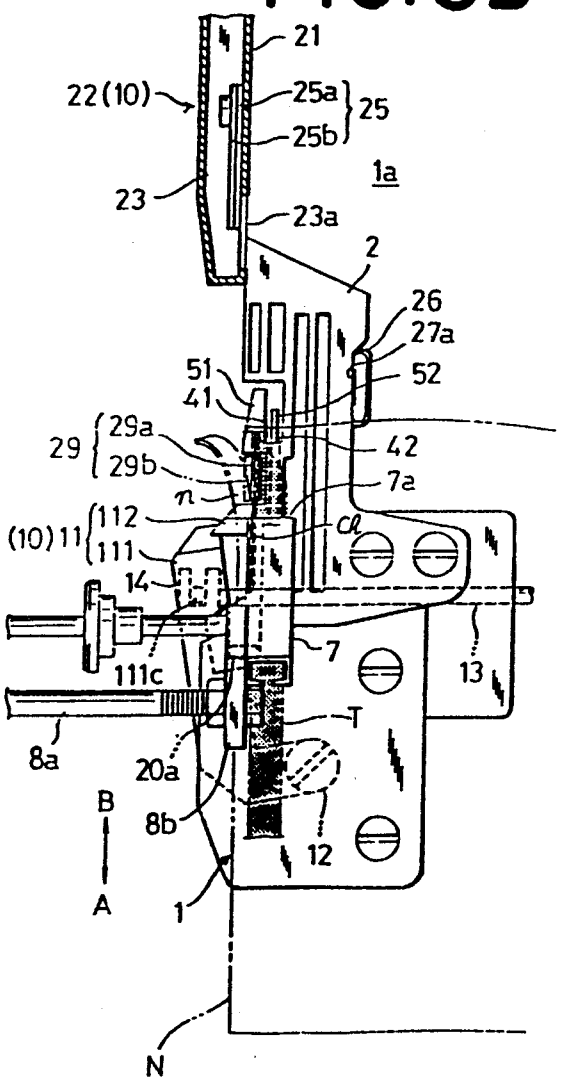
Figure 5C:
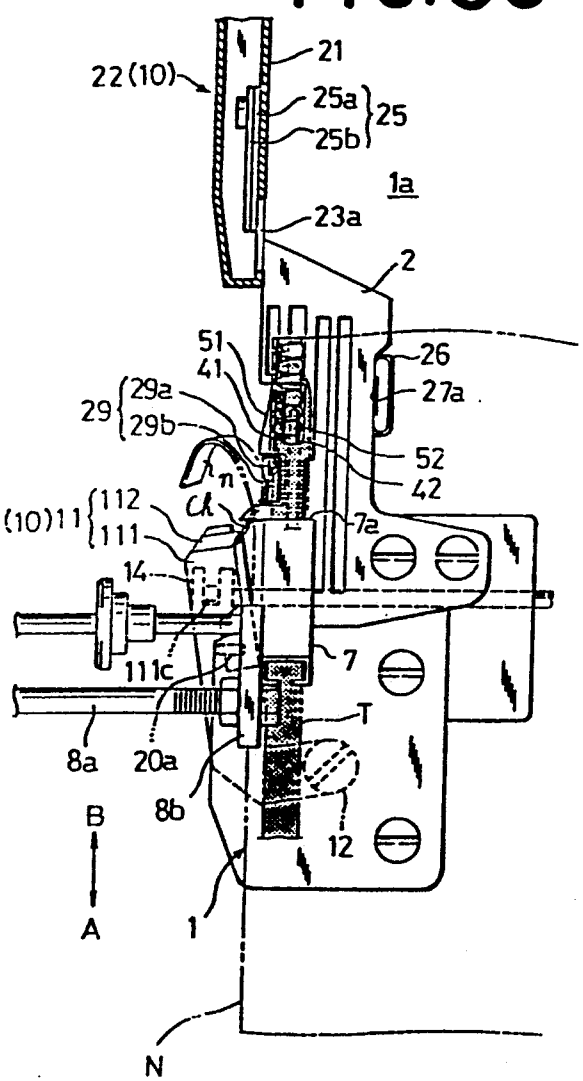
Figure 5D:
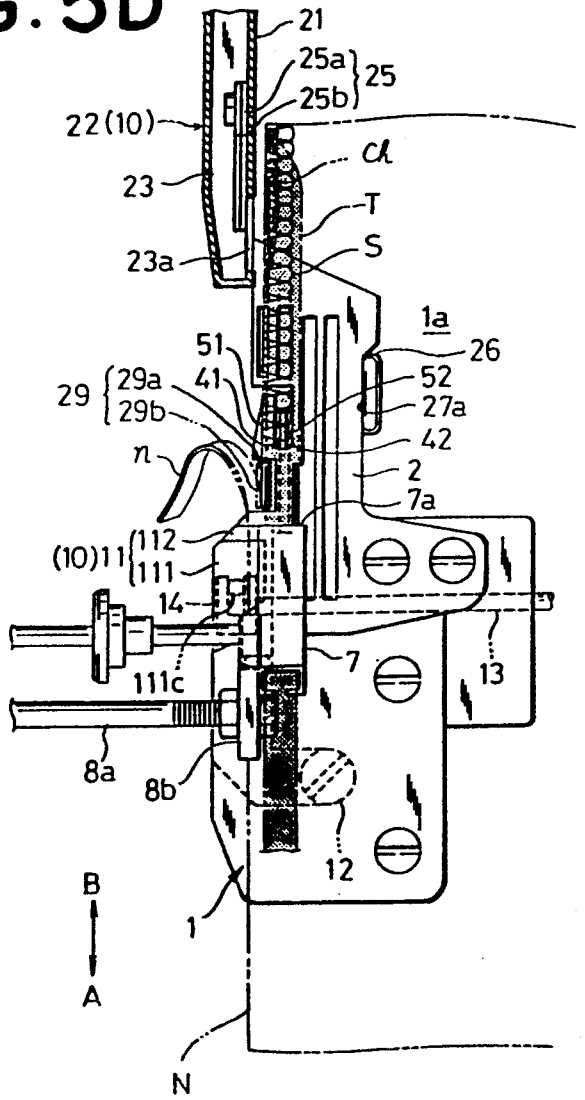
Figure 5E:
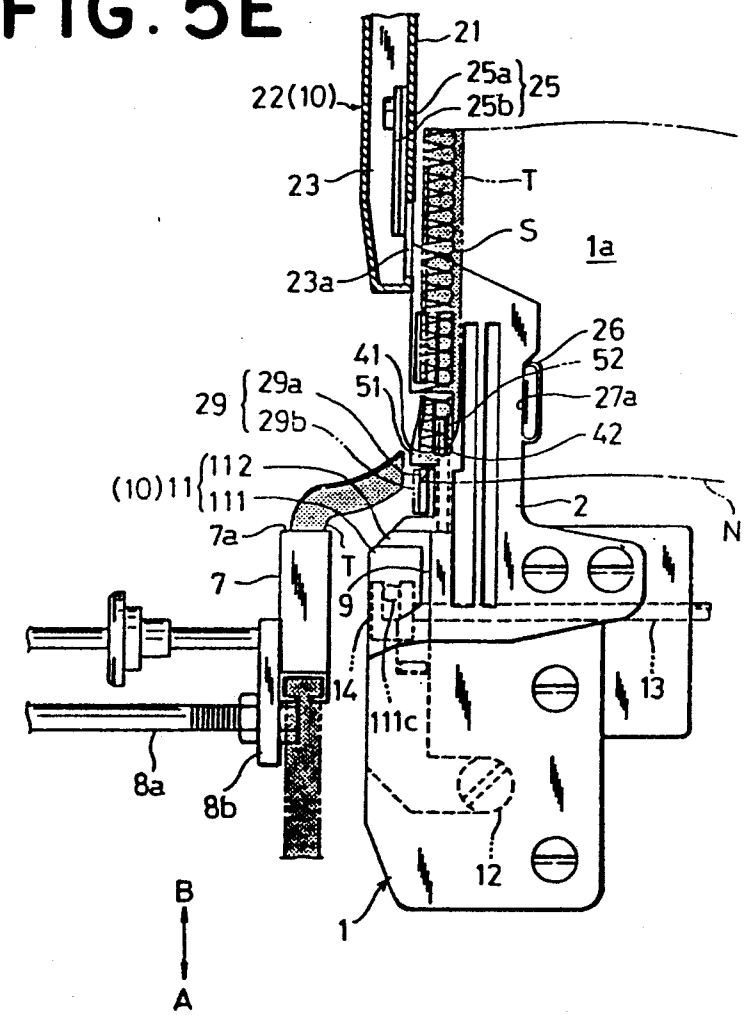
Figure 5F:
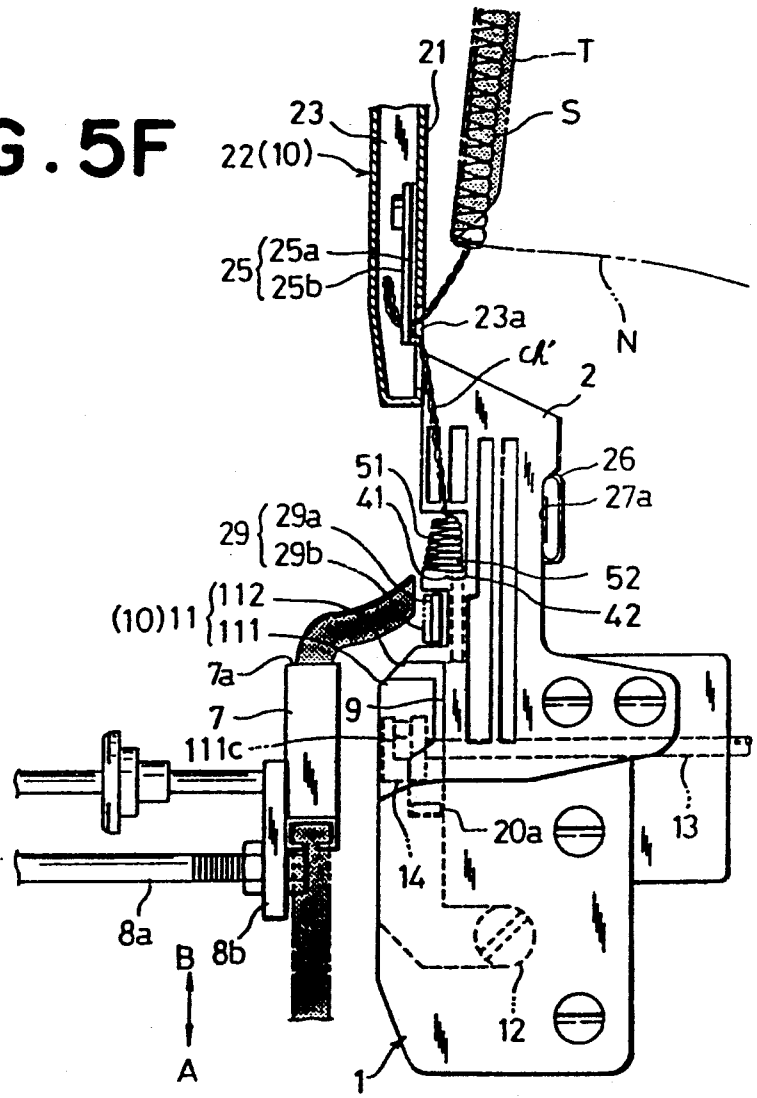
Figure 5G:
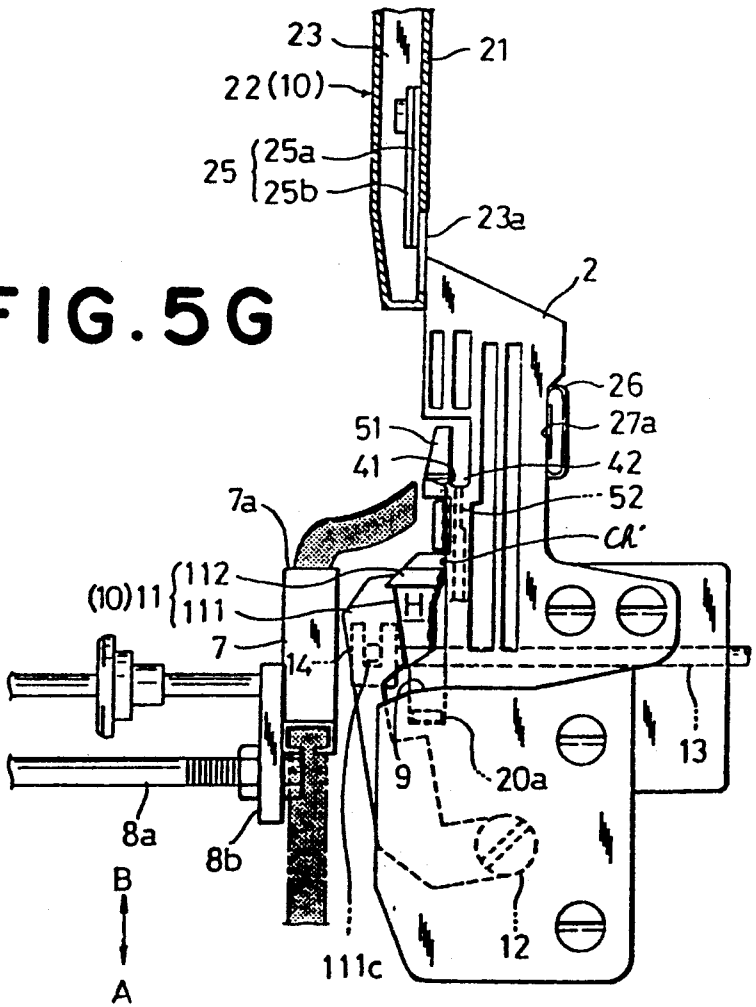

As clearly shown in FIGS. 5E to 5G, at the left side of the outside needle location 41 as seen from the sewing machine operator's side and on the working plane 1*a* at the operator's (arrow A direction) side of both needle locations 41, 42, there is a recess 9 extending to the right side and peripherally surrounded by the cloth plate 1 and throat plate 2. In this recess 9, a holding plate 11 is inserted. The upper surface thereof is flush with the working plane 1*a* and forms a part of the working plane 1*a*.

The holding plate 11 consists of a second holding plate 112 formed in an inverted L-shape as seen from the plane along the bottom and one rear side of the recess 9, and a first holding plate 111 placed into the inside corner of this second holding plate 112. The first holding plate 111 and the second holding plate 112 are always in tight contact with the side parallel to the cloth feeding direction.

On the first holding plate 111, an arm 111*a* is integrally formed, extending to the sewing machine operator's side beneath the cloth plate 1. On the second holding plate 112, an arm 112*a* is integrally formed, extending to the sewing machine operator's side further beneath the arm 111*a* of the first holding plate 111. The first holding plate 111 and the second holding plate 112 are rotatably mounted on the bracket 3 in the horizontal direction, by means of a bolt 12 which penetrates through the base part of the arms 111*a*, 112*a*. The second holding plate 112 is thrust normally to the side tightly contacting with the throat plate 2. This thrusting force is easily obtained by, for example, a torsional spring wound around the bolt 12 and abutting one end of the torsional spring to the arm 112*a*.

As shown in FIG. 2 and FIGS. 5A to 5G, a columnar operational stud 111*c* projects beneath the first holding plate 111. Moreover, there is a rod 13 which penetrates the bracket 3 and second holding plate 112 in the direction orthogonal to the cloth feeding direction. At one end of this rod 13, there is an engaging member 14 which engages the operational stud 111*c*. Therefore, the first holding plate 111 rotates about the bolt 12 by operating the rod 13 in the direction orthogonal to the cloth feeding direction. The rod 13 has male threads cut in the projecting part from the bracket 3, and a spring retainer 15 engages the male threads as shown in FIG. 1. A compression spring 16 is stretched between the spring retainer 15 and the bracket 3, and by the thrusting force of this compression spring 16, the first holding plate 111 engaged with the rod 13 is thrust in the direction (arrow C direction) contacting the second holding plate 112. Furthermore, beneath the cloth plate 1, a first air cylinder 17 is placed, and a rod pressure member 18 is fitted to the tip of its piston rod 17*a*. While the piston rod 17*a* is withdrawn, the rod pressure member 18 is abutting or approaching the leading end of the rod 13 as the first holding plate 111 and second holding plate 112 are in mutual contact. Therefore, when the first air cylinder 17 extends the piston rod 17*a*, the rod pressure member 18 presses the rod 13 by overcoming the thrusting force of the compression spring 16. By this pressure, the first holding plate 111 independently rotates about the bolt 12, and, as a result, an insertion inlet H at a free end of the chaining thread formed against the second holding plate 112 on the cloth plate 1 is opened as shown in FIG. 2.

On the other hand, the second holding plate 112 is driven by a second air cylinder 19 installed in the lower part of the overedge sewing machine and inside of the cloth plate 1. That is, the leading end of the piston rod 19*a* when extended in the vertical direction of the second air cylinder 19 hits against the rod receptacle 20*b* formed at one end of the L-shaped rocker arm 20. The other end 20*a* of the rocker arm 20 is engaged with the arm 112*a* of the second holding plate 112. The rocker arm 20 is to oscillate about its pivot 20*c*, and by oscillating the rod receptacle 20*b* vertically, the other end 20*a* oscillates laterally. Therefore, by extending the piston rod 19*a* and pushing up the rod receptacle 20*b*, the second holding plate 112 is rotated about the bolt 12 together with the first holding plate 111. That is, when the chaining thread is held between the inside corner of the second holding plate 112 and the first holding plate 111, this chaining thread holding part moves in the direction which crosses with the cloth feeding direction by rotating the second holding plate 112.

As shown in FIGS. 5A to 5G, behind the outside throat plate pawl 51, a cloth guide 21 is raised up from the working plane 1*a*. The cloth guide 21 is located at the left side of the outside needle location 41 by a specific distance, and is parallel to the cloth feeding direction.

Besides, behind the throat plate pawl 51, there is a chaining thread cutting device 22 having a suction passage 23 at the back side of the guide surface of the cloth guide 21. The suction passage 23 is connected to an air suction source which is not shown, using the rear side of the cloth guide 21 as a part of its inner wall. In the cloth guide 21, a suction hole 23*a* of the suction passage 23 is opened near the rear end of the throat plate 2. The suction passage 23 has a branched blow pipe 24 of a small diameter in order to pump air toward the suction hole 23*a* (see FIG. 1). The chaining thread cutting device 22 has a first cutter 25 disposed near the opening of the suction hole 23*a*. This first cutter 25 comprises a fixed blade 25*a* having its cutting tip fixed at the lower end of the rear side of the suction hole 23*a*, and a movable blade 25*b* rotatably pivoted outside the suction passage 23 and inserted into the suction passage 23 from above the suction passage 23. The movable blade 25*b* is designed to cross with the fixed blade 25*a* as it is being driven, for example, by a member interlocked with the main shaft of the sewing machine.

While operating the air suction source connected to the suction passage 23, when the rear end of the fabric forming a chaining thread consecutive to the seam is moved backward, the chaining thread is sucked through the suction hole 23*a* into the suction passage 23, and it crosses the first cutter 25. As a result, the chaining thread is cut off, leaving a certain length at the sewing machine side.

The movable blade 25 may not always driven in cooperation with the sewing machine as mentioned herein, and instead, for example, it may be designed to be driven by a solenoid or the like after stopping the sewing machine when the number of stitches reaches a specified value by counting the number of stitches of the rear end of the fabric passing the both needle locations 41, 42.

Obliquely right and ahead of the suction hole 23*a* and obliquely right behind and the holding plate 11, on the working plate 1*a* right side of the inside needle location 42, a slot 26 parallel to the cloth feeding direction is formed. From this slot 26, a nozzle 27*a* of the blow pipe 27 shown in FIG. 1 projects. The blow pipe 27 is connected to the air supply source (not shown). The nozzle 27*a* is opened toward the outside throat plate pawl 51 side, and it is formed to blow air toward the left oblique ahead side, that is, toward the holding plate 11 side, along the working plane 1*a*.

Above the insertion hole H formed as the first holding plate 111 is driven, a blow pipe 28 supported on the sewing machine main body M is disposed. A nozzle 28*a* which is the air blow-out port of the blow pipe 28 is disposed so as to blow air to the insertion hole H side from above.

The chaining thread processing device 10 thus comprises the holding plate 11, chaining thread cutting device 22, and the blow pipes 24, 27 and 28. This chaining thread processing device 10 separates the chaining thread formed consecutively with the rear end of the leading fabric from this fabric, transfers the free end of the chaining thread left over at the sewing machine side to before both needle locations 41, 42 by air, holds the free end of the transferred chaining thread before both needle locations 41, 42, and moves this chaining thread holding part in the direction orthogonal to the cloth feeding direction.

A second cutter 29 is disposed between the chaining thread holding part of the holding plate 11, that is, the position corresponding to the inside corner of the second holding plate 112 and the outside throat plate pawl 51. By turning the second holding plate 112 to the left, the chaining thread held by the chaining thread holding part crosses the second cutter 29. The second cutter 29 is disposed at the left side of both needle locations 41, 42 of the sewing machine M and, comprises a fixed blade 29*a* and a movable blade 29*b* parallel to the cloth feeding direction. The movable blade 29*a* moves in cooperation with driving of the sewing machine, and accordingly the second cutter 29 cuts off the unnecessary edge portion before reaching both needle locations 41, 42 as the fabric is being sewn. The second cutter 29 cuts off the tape T when the tape T extending out from the tape guide 7 crosses as the air cylinder 8 is operated.

A presser foot 30 for holding the fabric, which is the workpiece, against the throat plate 2 is mounted on the front end of a presses stand 31 oscillatably pivoted on the sewing machine main body at the rear side. The presser stand 31 oscillates by operating the air cylinder 32, and along with this oscillation, the presser foot 30 is moved up and down between the cloth pressing position and the releasing position. As shown in FIG. 4, a tape guide hole 30*a* is formed in the presser foot 30. The tape T extending out from the tape outlet 7*a* of the tape guide 7 at the action position can be inserted into this tape guide hole 30*a* from the left side of the presser foot 30. The tape T inserted into this tape guide hole 30*a* is guided to the lower specified side position of the presser foot 30. The tape T guided from the tape guide hole 30*a* to beneath the presser foot 30 is held between the presser foot 30 and the working plane 1*a* together with the fabric, in an overlapped state at the specified position on the fabric by lowering the presses foot 30. Therefore, the tape T is sent behind together with the fabric in this state as the sewing machine is driven.

Above the presser foot 30, there is a cloth sensor 33 composed of a photoelectric sensor or the like to detect presence or absence of cloth.

In this taped chaining thread sewing device CD, the sequence is controlled, as explained by reference to FIGS. 5A to 5G below, so that the inside throat plate pawl 52, air cylinder 8, chaining thread processing device 10, second cutter 29 and presses foot 30 may operate together. In these FIGS. 5A to 5G, the presser foot 30 is omitted for the sake of convenience.

FIG. 5A shows the state immediately before sewing is started by driving the sewing machine. In this state, the inside throat plate pawl 52 is located before both needle locations 41, 42, and is withdrawn at the waiting position beneath the throat plate 2. The chaining thread Ch is entangled on the outside throat plate pawl 51 at its base end part, while the free end side is held between the first holding plate 111 and the second holding plate 112 at the chaining thread holding part P. Furthermore, the piston rod 8*a* of the air cylinder 8 is extended, and the tape guide 7 is disposed at the action position. The tape T extending out from the tape outlet 7*a* is guided beneath the presser foot 30 (see FIG. 4), and its front end side droops to the left side of the cloth plate 1 behind the presser foot 30. The fabric N is set at the specified position, and the air cylinder 32 is actuated to lower the presser foot 30 by the signal from the cloth sensor 33 detecting the fabric N. The presser foot 30 holds the tape T together with the fabric N against the working plane 1*a*. Of course, the presser foot 30 may be lowered also manually.

When the sewing machine is driven in the state shown in FIG. 5A, the fabric N is sent to the rear side by the rotation of the main shaft and the action of the known cloth feed teeth not shown which cooperates therewith. Moreover, as the sewing machine is driven, the solenoid 6 is excited, and hence the inside throat plate pawl 52 advances to the action position. As the fabric N moves, the unnecessary edge portion n of the fabric N and the front end portion of the tape T cross with the second cutter 29. At this time, the movable blade 29*b* of the second cutter 29 cooperates with the driving of the sewing machine, and hence, as shown in FIG. 5B, the second cutter 29 simultaneously cuts off the crossing unnecessary edge portion n and the front end portion of the tape T. That is, the tape T is cut off so that its edge may not project from the fabric N. When the thus aligned fabric N and tape T pass through both needle locations 41, 42, seams are formed at the edge of the fabric N by the two-needle overedge sewing machine. At this time, the taped chaining thread sewing device CD sews the tape T into the upper surface of the fabric N by the thread forming the seam, and also sews the chaining thread Ch, the free end which is held in the chaining thread holding part P, into the lower surface of the fabric N.

In the taped chaining thread sewing device of the embodiment, when seam formation is started, for example, when several stitches are sewn as the front end of the fabric N passes through the needle locations 41, 42, the first air cylinder 17 is placed into action. As a result, as shown in FIG. 5B, only the first holding plate 111 rotates, and holding of the chaining thread Ch is temporarily released. In this way, curling of the front end of the fabric N due to pulling by the chaining thread is prevented. After this temporary release, the first holding plate 111 is returned to the original state to again hold the chaining thread Ch.

Thus, in the process of sewing the chaining thread Ch, in a specific time after driving the sewing machine, the second air cylinder 19 is actuated to extend the piston rod 19*a*. As a consequence, as shown in FIG. 5C, the second holding plate 112 rotates together with the first holding plate 111, and the chaining thread Ch held against the first holding plate 111 crosses the second cutter 29. The second cutter 29 cuts off the crossing chaining thread Ch together with the unnecessary edge portion n of the fabric N.

Thereafter, as shown in FIG. 5D, the chaining thread of specified length determined by properly setting the timing for rotating the second holding plate 112 is sewn into the begining portion of the seam, while the tape T is sewn into the upper surface side, thereby forming a seam S.

As the seam S forming advances, when the cloth sensor 33 no longer detects the fabric N, by the generated signal, passage of the final end of the fabric N beside the second cutter 29 is detected. Before the final end of the fabric N passes the second cutter 29, the air cylinder 8 is actuated to retract the piston rod 8*a*, and the tape guide 7 is moved from the action position to the waiting position as shown in FIG. 5E. As a result, the tape T between the tape outlet 7*a* and the sewn part of the fabric N crosses the second cutter 29. Thus, the second cutter 29 cuts off the crossing tape T together with the unnecessary edge portion at the final end of the fabric N. The timing for operating the air cylinder 8 may be when or before the final end of the fabric N passes the second cutter 29. Therefore, it may not be necessarily based on the signal generated when the cloth sensor 33 no longer detects the fabric N, and for example, it may be the time when sewing is advanced by a specific number of stitches from the seam formation start point. If, instead, the tape T is cut off after the final end of the fabric N has passed the second cutter 29, the tape T may be projected from the final end of the fabric N, which is not preferable.

By further driving the sewing machine after cutting off the sewing machine, the tape T is sewn entirely into the fabric N, and the formation of the seam S on the fabric N is over. After termination of seam forming, by further driving the sewing machine by a specified number of stitches to entangle the thread on the outside throat plate pawl 51 and inside throat plate pawl 52, a chaining thread Ch' consecutive to the final end of the seam is formed as shown in FIG. 5F.

While forming the chaining thread Ch' in this way, as the cloth sensor 33 no longer detects the fabric N, the air suction source connected to the suction passage 23 is operated. Thus, as shown in FIG. 5F, as the final end of the fabric N moves to the rear side of the suction hole 23*a*, the suction hole 23*a* sucks the chaining thread Ch'. Therefore, the movable blade 25*b* of the first cutter 25 cooperates with the driving of the sewing machine, automatically cuts off the chaining thread Ch' from the fabric N. At this time, the chaining thread Ch' is cut off, leaving an approximately specific length at the sewing machine side. Meanwhile, the movement of the fabric N to the rear side of the sewing machine is carried out as the fabric N is being pulled out of the sewing machine, and this movement for removal may be done by the operator, or by a forced feeding action by any feeding device.

When driving for a specified number of stitches for forming the chaining thread Ch' is over, the machine stops, and the presser foot 30 goes up. At the same time, the solenoid 6 is actuated, and the inside throat plate pawl 52 retreats to the waiting position.

After the sewing machine stops, the operation of the air suction source connected to the suction passage 23 is stopped, and air is momentarily pumped into the suction passage 23 from the blow pipe 24, and the free end of the chaining thread Ch' moves to the front side of the nozzle 27*a* of the blow pipe 27 obliquely left ahead of the suction hole 23*a*.

In succession, air is blown out from the nozzle 27*a* of the blow pipe 27 and the nozzle 28*a* of the blow pipe 28, and at the same time the first air cylinder 17 is actuated to extend the piston rod 17*a*. By the air blown out from the nozzle 27*a*, the free end side of the chaining thread Ch' moves from ahead of the nozzle 27*a* further to the holding plate 11 side. On the other hand, along with extension of the piston rod 17*a*, as shown in FIG. 5G, the first holding plate 111 rotates to open the insertion hole H against the second holding plate 112. Therefore, the free end of the chaining thread Ch' is sucked into the insertion hole H by the air blown out from the nozzle 28*a*. Meanwhile, since the inside throat plate pawl 52 is moved to the waiting position, the free end side of the chaining thread Ch' moves from ahead of the nozzle 27*a* to the holding plate 11 side, and the chaining thread Ch' escapes securely from the outside needle location 41 without interfering with the outside needle location 41. Therefore, the chaining thread Ch' is not sewn into the fabric by the needle thread by the outside sewing needle, and a product of high quality may be obtained.

Next, the piston rod 17*a* of the first air cylinder 17 is retracted, the first holding plate 111 is rotated to the right side, and the insertion hole H is clogged. As a result, the chaining thread Ch' is held between the first holding plate 111 and the second holding plate 112 at its free end side, and is set in this state between the chaining thread holding part and outside throat plate pawl 51 (see FIG. 5A). In this way, the chaining thread Ch' is moved from behind the needle location to ahead of the needle plate by the chaining thread processing device 10, and at this time since the inside throat pawl 52 is drawn back to the waiting position, the chaining thread Ch' will not be set in the same position as the outside needle location 41.

Figure 6A:
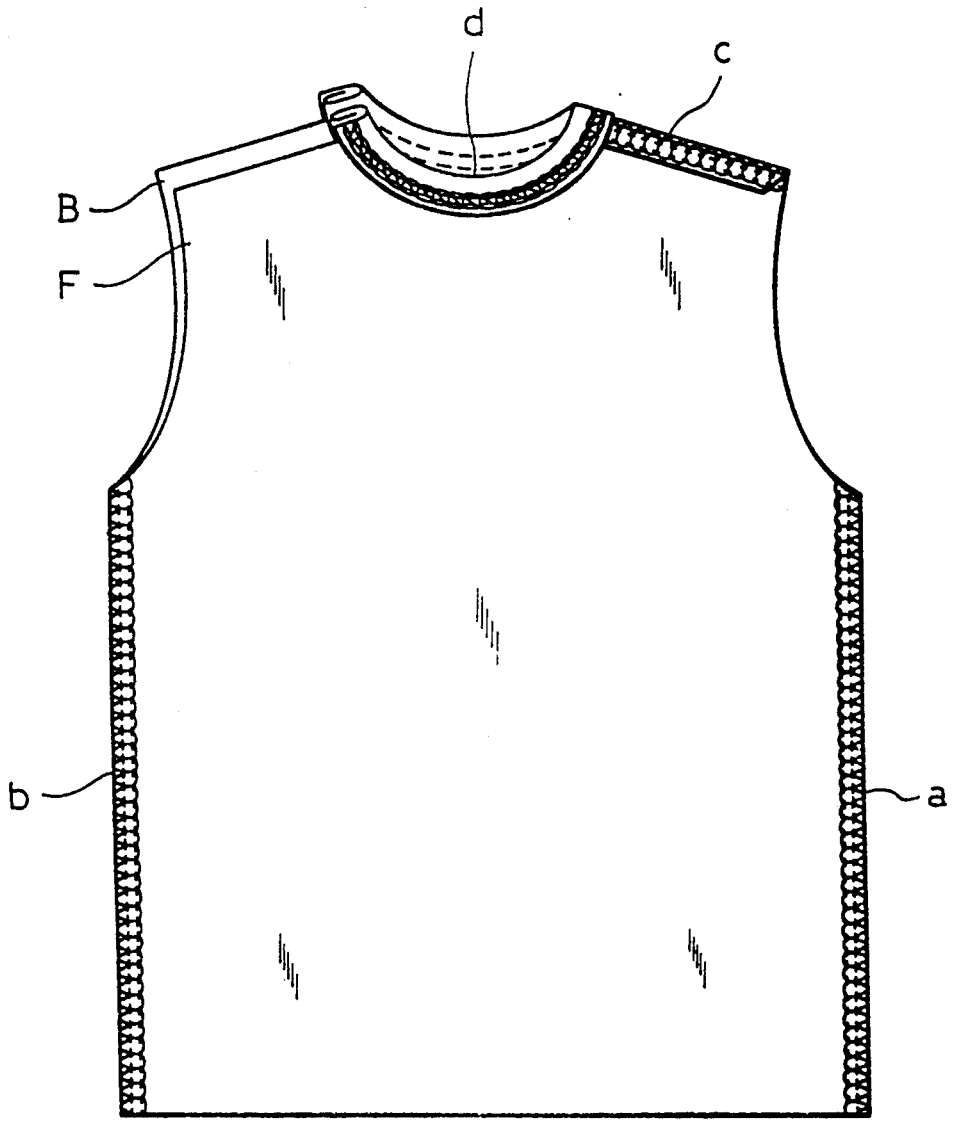
FIG. 6A is a front view of clothing inverted before attaching the left shoulder.

An example of the use of an overedge sewing machine provided with the taped chaining thread sewing device CD is as followed. FIG. 6A shows the state of clothes having side sewings a, b, right shoulder attaching c, and tubing d along the neck line, executed on the front body F and back body B in inverted state. In this case, the right shoulder attaching c is effected by the right sewing machine having the leg part of the sewing machine main body located at the right side of the needle location, and tubing d is effected, starting and ending with the inner end part of the left shoulder side.

Figure 6B:
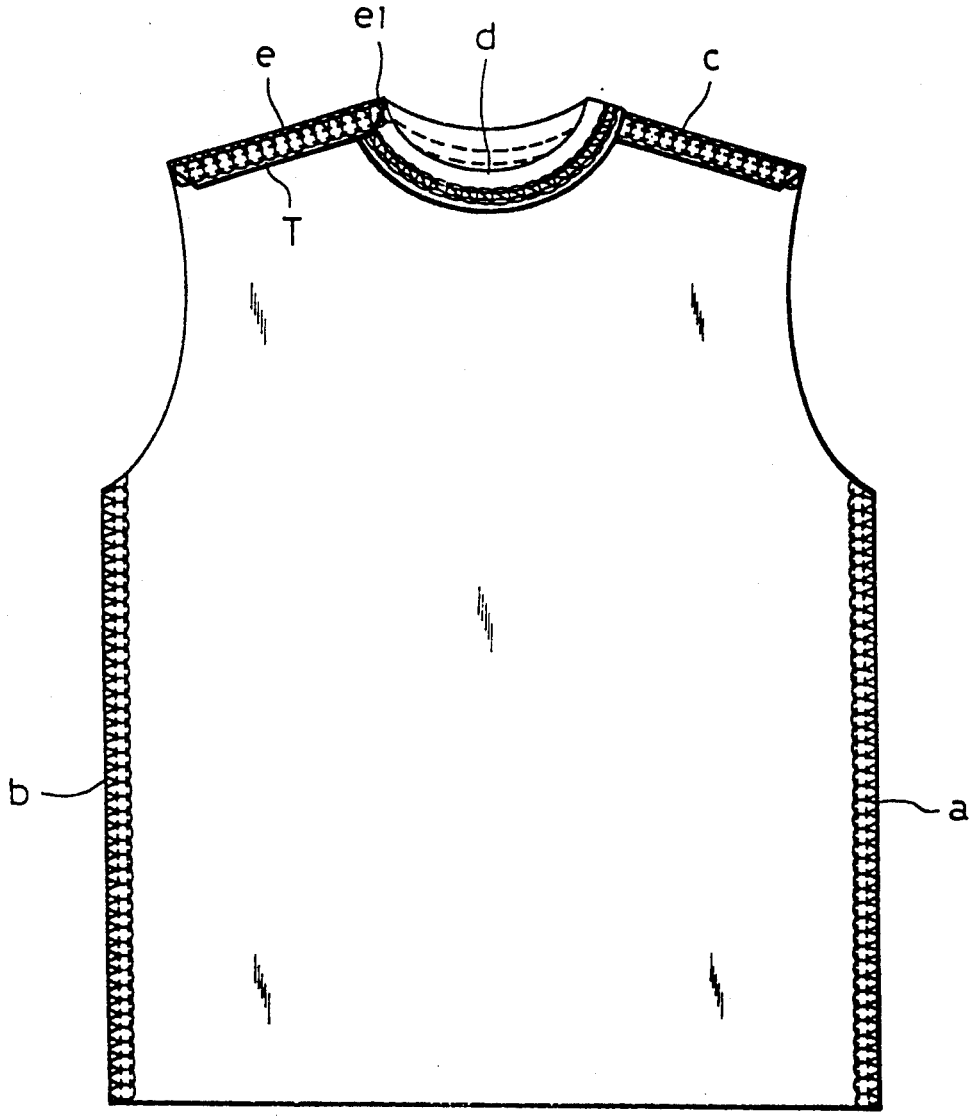
FIG. 6B is a front view of clothing inverted after attaching the shoulder.
Figure 7:
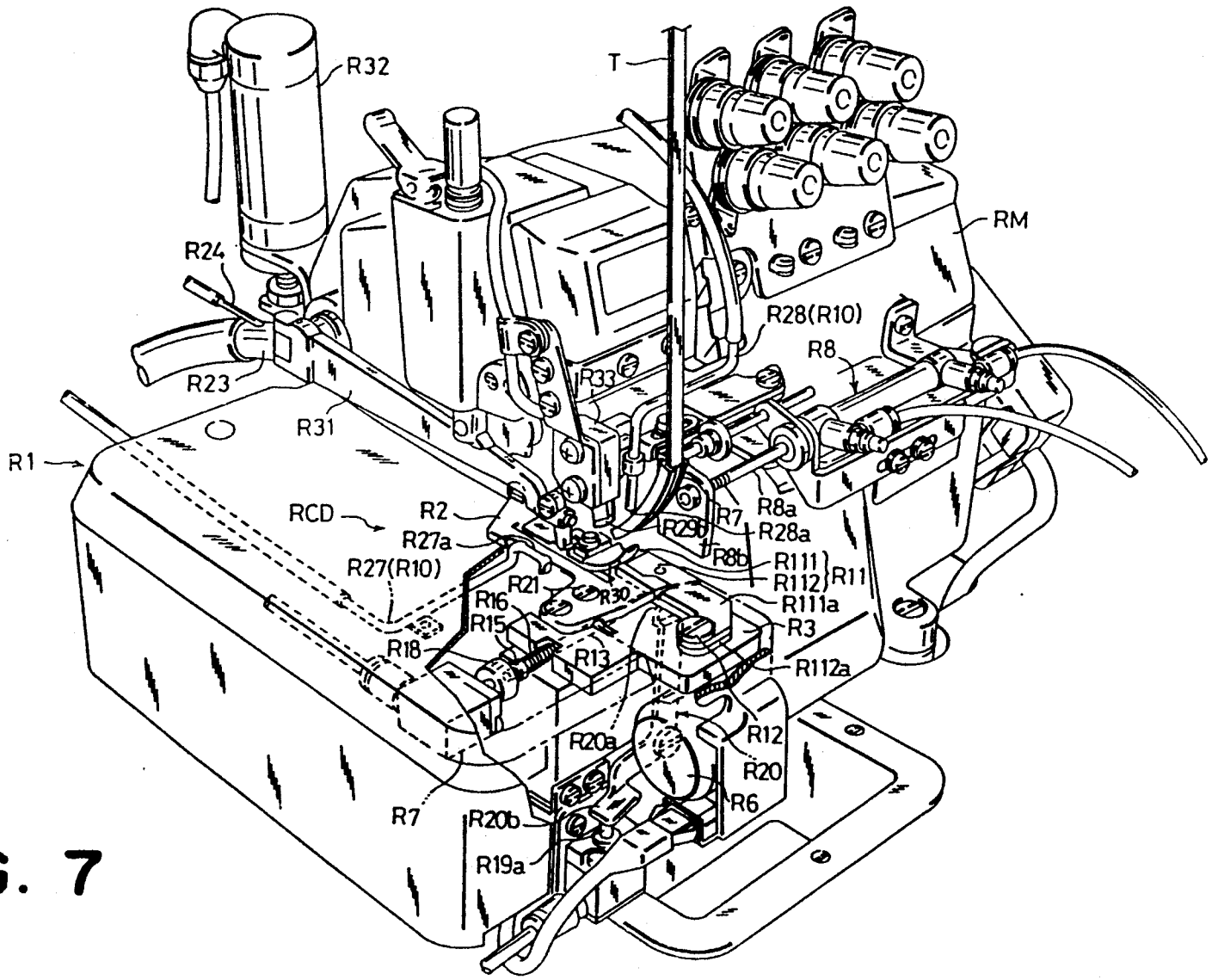
FIG. 7 is a partially cut-away perspective view of a right overedge sewing machine equipped with a taped chaining thread sewing device.
Figure 8C:
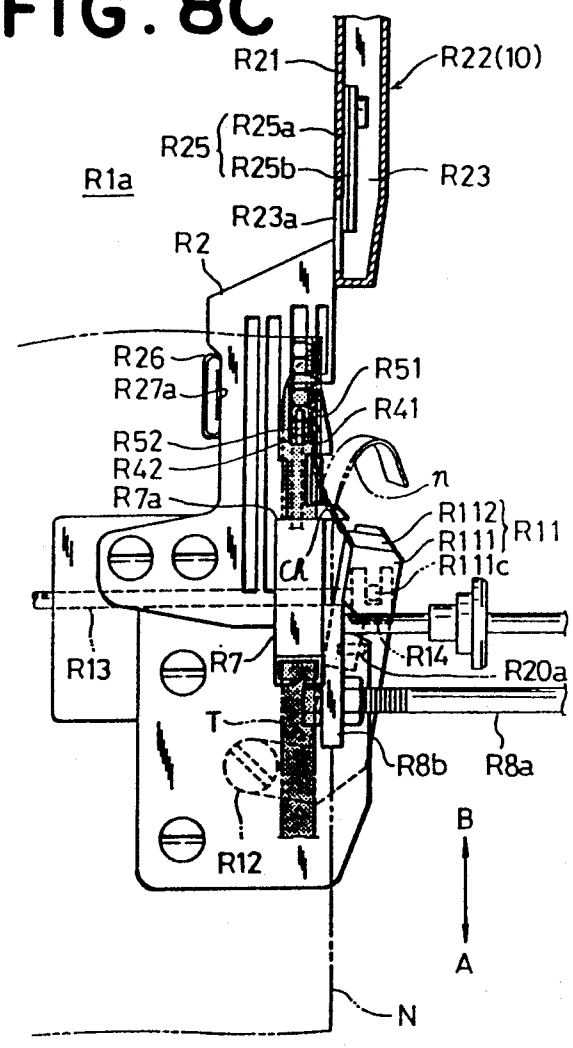
FIG. 8A to FIG. 8G are operation explanatory drawings showing the sewing process accompanying taping and chaining thread sewing by a right overedge sewing machine.
Figure 8B:
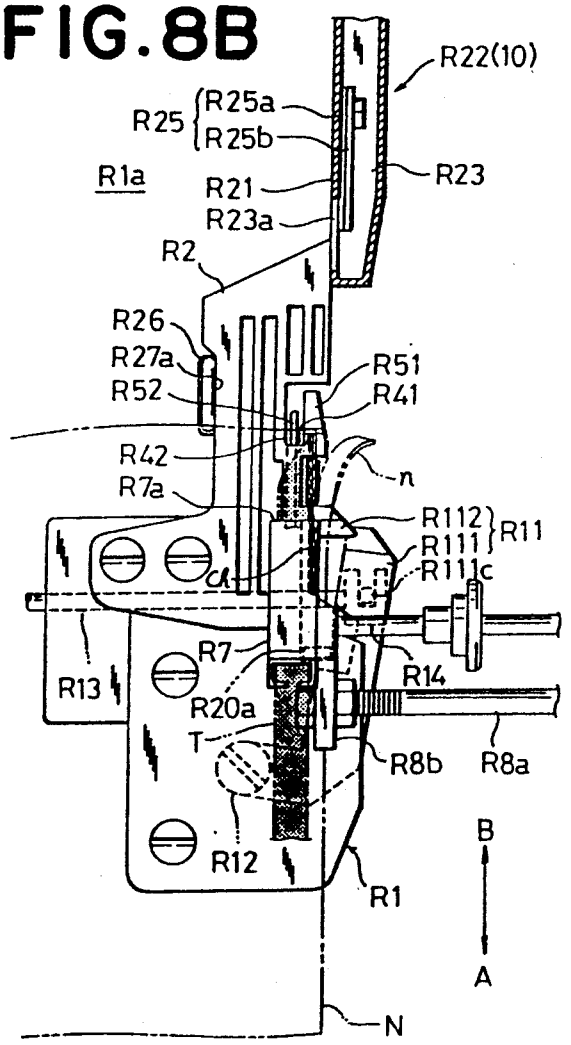
Figure 8A:
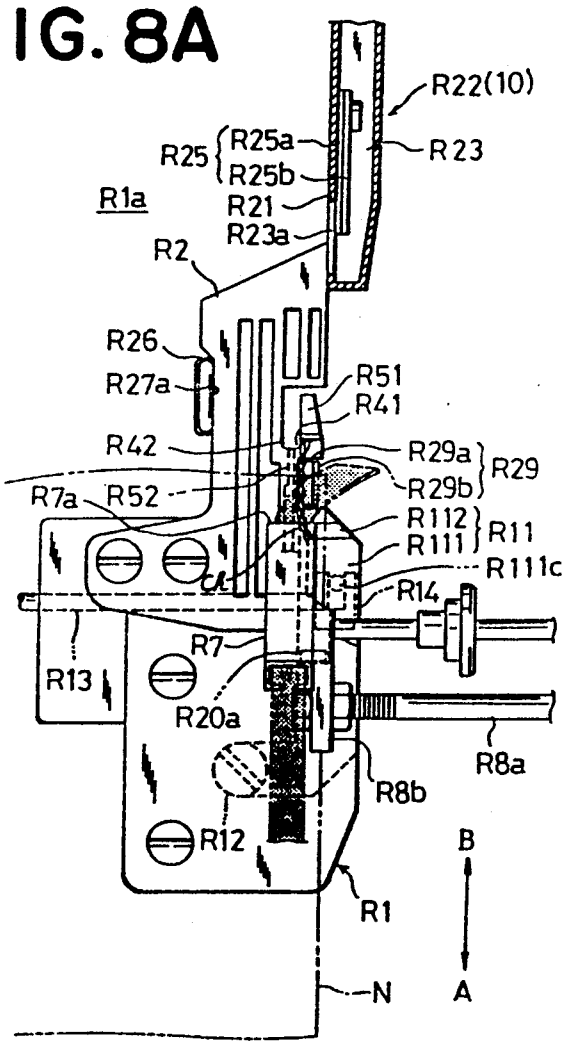
Figure 8E:
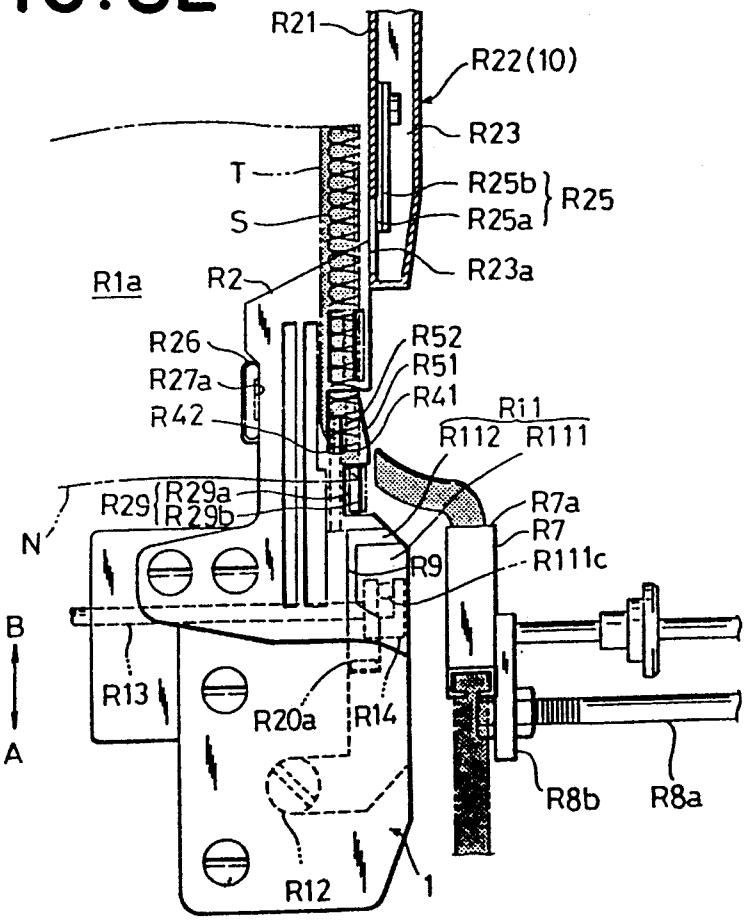
Figure 8D:
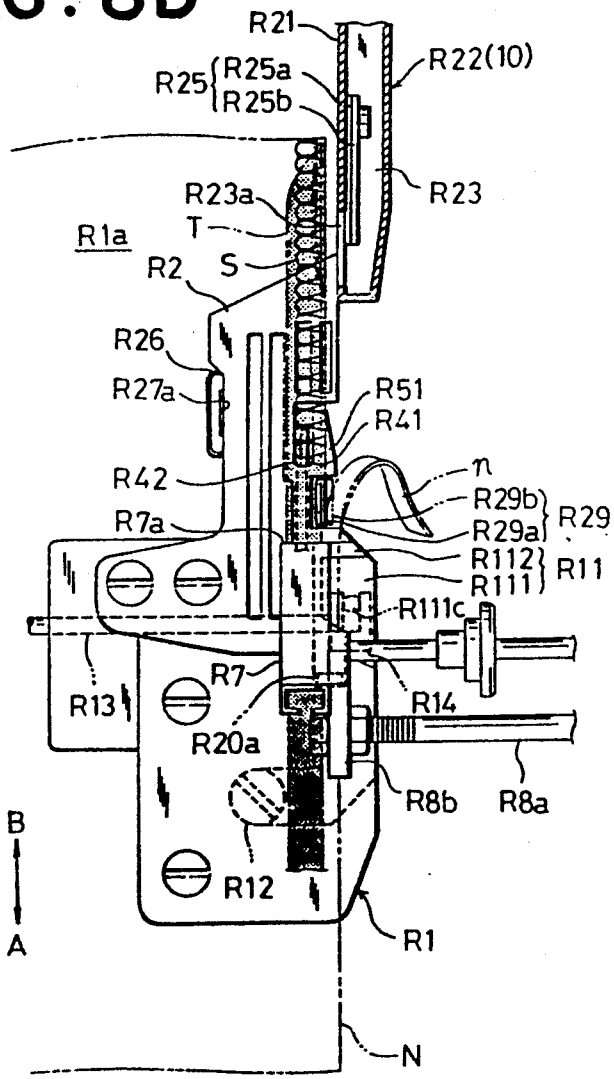
Figure 8G:
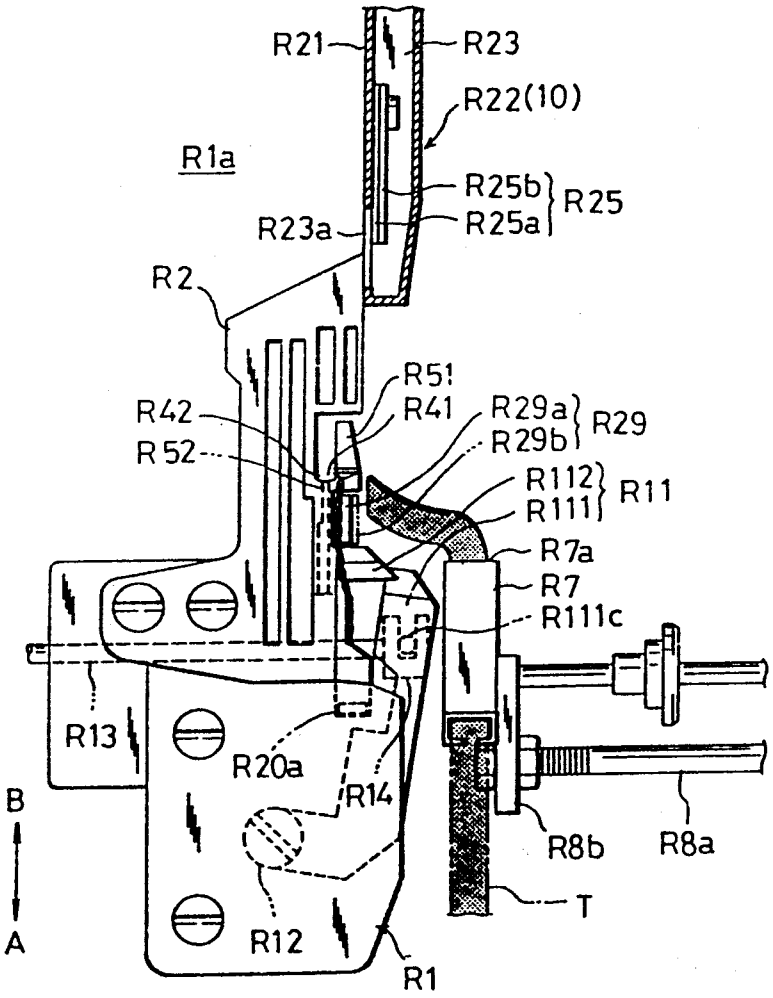
Figure 8F:
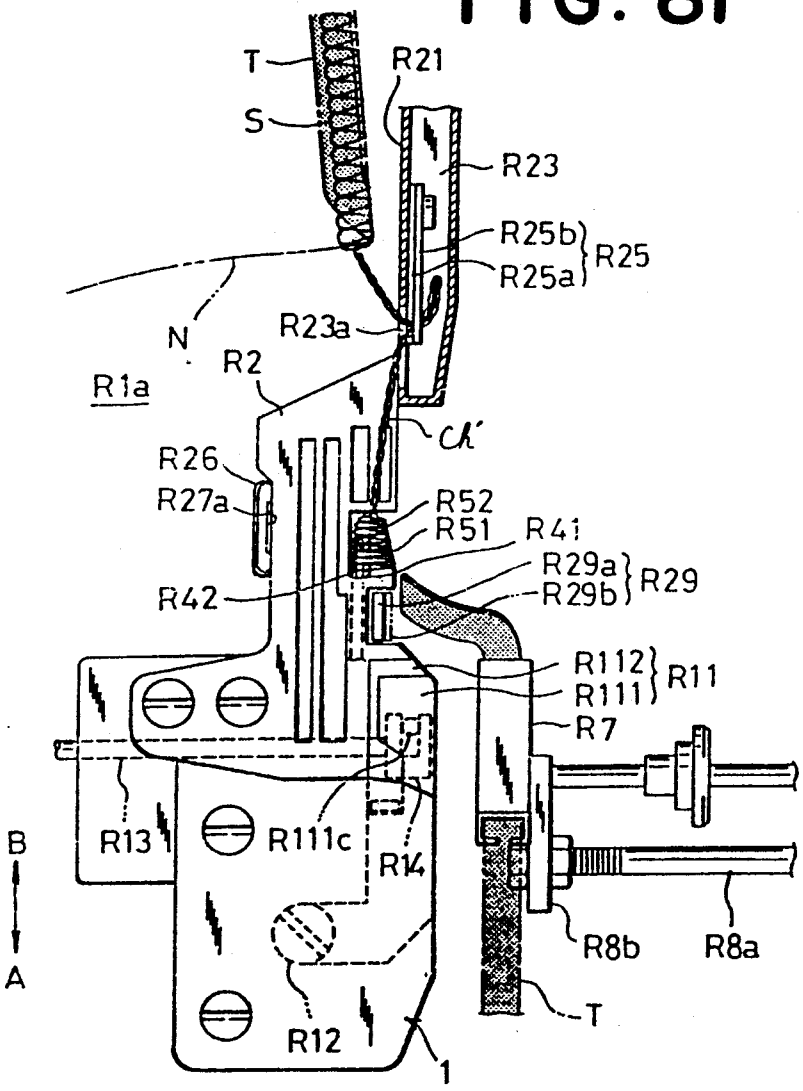

According to such an overedge sewing machine equipped with a taped chaining thread sewing device, the shoulder attaching c of the left side having a tape sewn to the front body F side of the clothes in the state shown in FIG. 6A can be executed by sewing in the direction from the inner end side to the outer end side of the left shoulder part. FIG. 6B shows the state of inverted clothes after the left shoulder attaching e is sewn. This left shoulder attaching e is realized by simultaneous sewing of the start and end of the tubing d at the starting part e1 of sewing at the left shoulder inner end side. At the starting part e1 of sewing of the back body of this shoulder attaching e, the chaining thread set between the outside throat plate pawl 51 and the holding plate 11 at the chaining thread holding part is sewn in. Therefore, in the subsequent process, bar tacking is not particularly needed, and this sewing start portion will be prevented from unraveling. On the other hand, the sewing end part at the left shoulder outer end side is attached with the sleeve, and bar tacking in particular is not needed.

FIG. 7 and FIGS. 8A to 8G illustrate the taped chaining thread sewing device installed in the right overedge sewing machine, having the leg part of the sewing machine main body RM and the second cutter R29 disposed at the right side of the outside needle location R41. The taped chaining thread sewing device shown herein is symmetrical to the structure shown in FIGS. 1 to 5G, and all actions are done symmetrically as shown in FIGS. 8A to 8G. Therefore, the parts shown in FIG. 7 and FIGS. 8A to 8G are indicated by attaching the symbol R to the corresponding part numbers in FIGS. 1 to 5G, and their detailed description is omitted herein.

Figure 9:
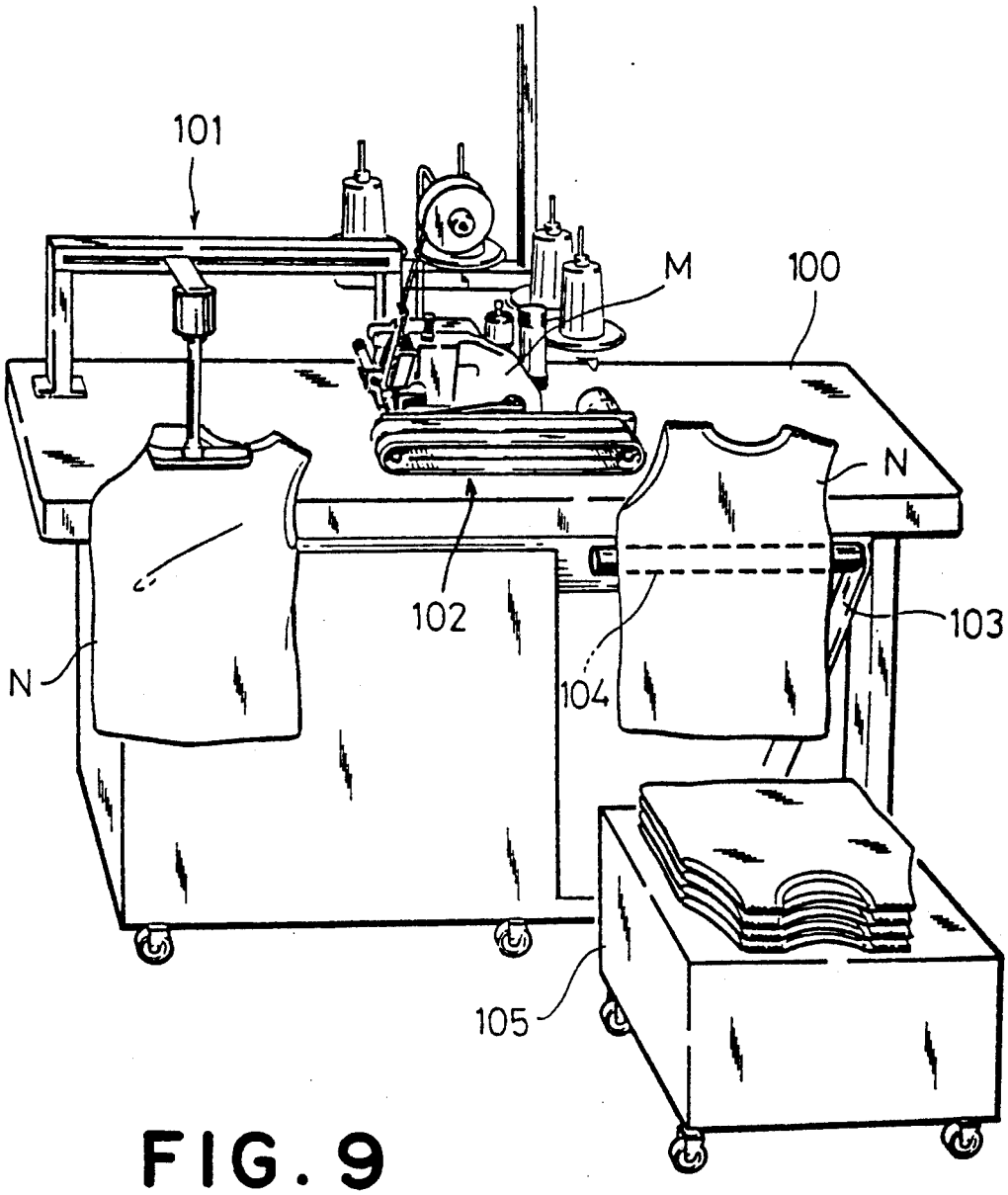
FIG. 9 is a schematic perspective view showing a modified example of a left overedge sewing machine equipped with a taped chaining thread sewing device.

FIG. 9 shows a modified example of a left overedge sewing machine equipped with the same taped chaining thread sewing machine as shown in FIGS. 1 to 5G. In this left overedge sewing machine, instead of the cloth plate 1, a work bench 100 is provided. On this work bench 100 is mounted a carrier 101 for holding the fabric N to be sewn against its upper surface and carrying it from the sewing machine operator's side to the rear side of the sewing machine main body M (the right side in the drawing). At the right side of the sewing machine main body M (at the operator's side in the drawing), a feed device 102 is installed in order to feed the fabric N carried by the carrier 101 by force into the needle location and moving in the cloth feeding direction after the end of sewing. The fabric N which is sent to the sewing machine rear side by the feed device 102 and sewn is stacked up on a conveying table 105 to the next state from above the work bench 100 by the rod 104 mounted on the rocker arm 103 behind the sewing machine.

In the foregoing examples, the inside throat plate pawl is provided in the two-needle overedge sewing machine which moves back and forth, in the taped chaining thread sewing machine explained in relation to the invention, but the overedge sewing machine may also be of the one-needle type, or the inside throat plate pawl of the two-needle overedge sewing machine may not move back and forth. Besides, the practical composition of the chaining thread processing device is not limited to the illustrated embodiment, and any other structure may be employed as far as the chaining thread formed consecutively to the final end of the cloth is separated from the preceding fabric, the chaining thread left over at the sewing machine side is held at the chaining thread holding part before the needle location, and this chaining thread holding part is allowed to move in the direction crossing the cloth feeding direction.

What is claimed is:

1. A taped chaining thread sewing device for an overedge sewing machine having a needle location and a throat plate pawl, and defining a cloth feed direction along which a fabric is fed, comprising:

a tape guide for guiding a tape extending from above and into the needle location of the overedge sewing machine, said tape guide having an outlet;

a guide drive device for moving the tape extending out from the tape outlet between an action position opposite to the needle location and a waiting position set aside from the action position, in a direction which crosses the cloth feed direction;

a chaining thread processing device for holding the free end of a chaining thread left over at the sewing machine side including a chaining thread holding part disposed ahead of the needle location, and moving in a direction which crosses the cloth feed direction;

a cutting device located between the throat plate pawl and the chaining thread holding part, and in a position crossed by the chaining thread holding part when the chaining thread holding part is moved, said cutting device having a second movable cutter operating in cooperation with the driving of the overedge sewing machine; and a sensor for detecting the presence or absence of a fabric ahead of the needle location, wherein the tape guided by the tape guide and extending therefrom is sewn into the upper side of the fabric and the chaining thread held at the operator's side of the needle location is sewn into the lower side of the fabric, wherein the cutting device cuts off the leading tape from the portion sewn into the fabric together with an unnecessary edge portion of the fabric at the start of sewing, wherein the chaining thread processing device moves the chaining thread holding part to cut the chaining thread by crossing with the cutting device when the chaining thread is sewn into the fabric to a specified length, and wherein the guide driving device moves the tape guide from the action position to the waiting position in accordance with a signal generated by said sensor after detecting the end part of the fabric.

2. A taped chaining thread sewing device according to claim 1, wherein the guide drive device moves the tape guide from the action position to the waiting position when the number of stitches reaches a specified value from the start point of forming a seam on the fabric.

3. A taped chaining thread sewing device according to claim 1, wherein the chaining thread processing device further includes a suction device disposed at the rear side of the needle location and defining a suction hole in which a first movable cutter is disposed, said chaining thread processing device drawing and cutting the chaining thread formed consecutively at the edge of the fabric, after the second cutter cuts off the crossed tape together with the edge of the fabric along with backward movement of the fabric into the suction hole, and wherein the free end of the chaining thread left over at the sewing machine side by the cutting with the first cutter is moved by air pressure from behind the needle location to the chaining thread holding part ahead of the needle location.

4. A taped chaining thread sewing device according to claim 1, wherein the chaining thread holding part comprises two holding plates which open a chaining thread insertion port in the cloth plate during movement of one of the holding plates, and wherein the chaining thread holding part moves in the direction which crosses the cloth feed direction during movement of the other holding plate.

5. A taped chaining thread sewing device according to claim 3, wherein the chaining thread holding part comprises two holding plates which open a chaining thread insertion port in the cloth plate during movement of one of the holding plates, and wherein the chaining thread holding part moves in the direction which crosses the cloth feed direction during movement of the other holding plate.

6. A taped chaining thread sewing device according to claim 4, wherein the overedge sewing machine is a two-needle overedge sewing machine, the throat plate pawl comprises an inside throat plate pawl and an outside throat plate pawl, said inside throat plate pawl being withdrawn from the action position parallel to the outside throat plate pawl to the waiting position at the operator's side, and wherein the inside throat plate pawl advances from the withdrawn position to the action position when the sewing machine is driven, and withdraws to the waiting position when sewing of the fabric is over, and before the chaining thread which has been formed and separated from the fabric is moved to the needle location operator's side by air pressure.

7. A taped chaining thread sewing device according to claim 5, wherein the overedge sewing machine is a two-needle overedge sewing machine, the throat plate pawl comprises an inside throat plate pawl and an outside throat plate pawl, said inside throat plate pawl being withdrawn from the action position parallel to the outside throat plate pawl to the waiting position at the operator's side, and wherein the inside throat plate pawl advances from the withdrawn position to the action position when the sewing machine is driven, and withdraws to the waiting position when sewing of the fabric is over, and before the chaining thread which has been formed and separated from the fabric is moved to the needle location operator's side by air pressure.

8. A taped chaining thread sewing device according to claim 1, wherein the guide drive device moves the tape guide from the action position to the waiting position when the number of stitches reaches a specified value from the start point of forming a seam on the fabric.

9. A taped chaining thread sewing device according to claim 1, wherein the overedge sewing machine is a left sewing machine and the second cutter is disposed at the left side of the needle location of the left sewing machine as seen from the operator's side.

10. A taped chaining thread sewing device according to claim 2, wherein the overedge sewing machine is a left sewing machine and the second cutter is disposed at the left side of the needle location of the left sewing machine as seen from the operator's side.

11. A taped chaining thread sewing device according to claim 7, wherein the overedge sewing machine is a left sewing machine and the second cutter is disposed at the left side of the needle location of the left sewing machine as seen from the operator's side.

12. A taped chaining thread sewing device according to claim 9, wherein the overedge sewing machine is a left sewing machine and the second cutter is disposed at the left side of the needle location of the left sewing machine as seen from the operator's side.

13. A taped chaining thread sewing device according to claim 8, wherein the overedge sewing machine is a left sewing machine and the second cutter is disposed at the left side of the needle location of the left sewing machine as seen from the operator's side.

14. A taped chaining thread sewing device according to claim 11, wherein the overedge sewing machine is a left sewing machine and the second cutter is disposed at the left side of the needle location at the left sewing machine as seen from the operator's side.

* * * * *